United States Patent [19]

Cheung

[11] Patent Number: 4,755,202

[45] Date of Patent: Jul. 5, 1988

[54] PROCESS AND APPARATUS TO PRODUCE ULTRA HIGH PURITY OXYGEN FROM A GASEOUS FEED

[75] Inventor: Harry Cheung, Buffalo, N.Y.

[73] Assignee: Union Carbide Corporation, Danbury, Conn.

[21] Appl. No.: 78,757

[22] Filed: Jul. 28, 1987

[51] Int. Cl.[4] ..... F25J 3/04

[52] U.S. Cl. ..... 62/17; 62/20; 62/28; 62/31; 62/34

[58] Field of Search ..... 62/9, 11, 17, 20, 22, 62/23, 24, 27, 28, 29, 31, 32, 34, 36, 42; 55/68, 69

[56] References Cited

U.S. PATENT DOCUMENTS

| | | | |
|---|---|---|---|
| 2,519,892 | 8/1950 | Dennis | 62/175.5 |
| 2,815,650 | 12/1957 | McIntire et al. | 62/34 X |
| 3,363,427 | 1/1968 | Blanchard et al. | 62/21 |
| 3,620,032 | 11/1971 | Simonet | 62/28 |
| 3,718,006 | 2/1973 | Ranke et al. | 62/17 |
| 4,433,990 | 2/1984 | Olszewski | 62/34 X |
| 4,448,595 | 5/1984 | Cheung | 62/34 X |
| 4,560,397 | 12/1985 | Cheung | 62/28 |
| 4,604,117 | 8/1986 | Cheung | 62/28 X |
| 4,615,716 | 10/1986 | Cormier et al. | 62/24 |

*Primary Examiner*—Steven E. Warner

*Attorney, Agent, or Firm*—Stanley Ktorides

[57] ABSTRACT

A process and apparatus to produce ultra high purity oxygen comprising serially oriented absorbing and stripping columns having defined flow stream relationships.

25 Claims, 3 Drawing Sheets

FIG. 3
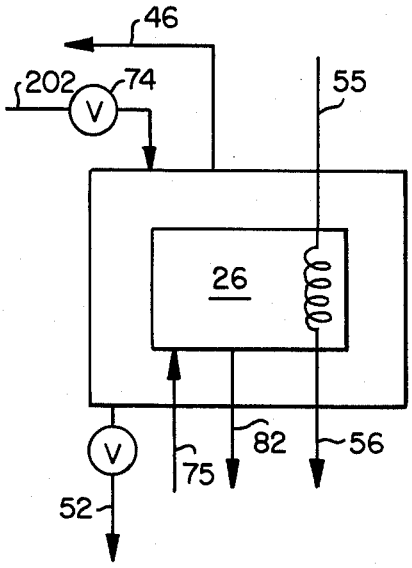
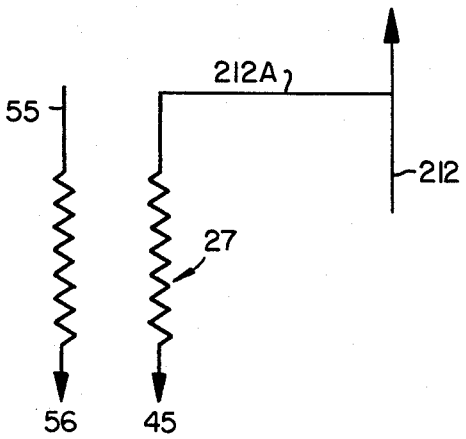
FIG. 4

PROCESS AND APPARATUS TO PRODUCE ULTRA HIGH PURITY OXYGEN FROM A GASEOUS FEED

TECHNICAL FIELD

This invention relates generally to the production of ultra high purity oxygen and more particularly to the production of ultra high purity oxygen from a gaseous feed stream.

BACKGROUND ART

Commercial grade high purity oxygen has a nominal purity of 99.5 percent. Generally commercial grade high purity oxygen is produced by the well known cryogenic fractional distillation of air, most often using a stacked double column arrangement. The commercially available high purity oxygen is suitable for use in a great many applications.

Commercial grade high purity oxygen contains a small amount of impurities. The impurities include both light impurities having a vapor pressure greater than oxygen, and heavy impurities having a vapor pressure less than oxygen. Occasionally oxygen is required which has significantly less impurities than the commercially available high purity oxygen. In these instances, high purity oxygen has heretofore been upgraded to ultra high purity oxygen by means of catalytic combustion.

The electronics industry requires the use of ultra high purity oxygen for many applications. However, the conventional catalytic combustion method for producing ultra high purity oxygen is not suitable because of the consequent production of particulates generated from the granulated catalyst.

It is desirable therefore to have a process and apparatus to produce ultra high purity oxygen without need for the use of catalytic combustion.

Accordingly, it is an object of this invention to produce ultra high purity oxygen without need for the use of catalytic combustion.

It is a further object of this invention to produce ultra high purity oxygen by the upgrading of high purity oxygen produced by the cryogenic fractional distillation of air.

SUMMARY OF THE INVENTION

The above and other objects which will become apparent to those skilled in the art upon a reading of this disclosure are attained by the present invention one aspect of which is:

A process to produce ultra high purity oxygen from a gaseous feed comprising:

(a) introducing gaseous feed containing oxygen, light impurities and heavy impurities into an absorbing column;

(b) passing gaseous feed up the absorbing column and absorbing heavy impurities from ascending gas into descending liquid;

(c) condensing resulting gas, passing a first liquid portion thereof into a stripping column and passing a second portion thereof down the absorbing column as said descending liquid;

(d) passing first liquid portion down the stripping column and stripping light impurities from the downflowing liquid into upflowing vapor to produce ultra high purity oxygen liquid;

(e) vaporizing ultra high purity oxygen liquid and passing resulting vapor up the stripping column as said upflowing vapor; and (f) recovering product ultra high purity oxygen.

Another aspect of this invention is:

Apparatus to produce ultra high purity oxygen from a gaseous feed comprising:

(a) an absorbing column having feed introduction means;

(b) a stripping column;

(c) heat exchanger means;

(d) means to pass vapor from the upper portion of the absorbing column to the heat exchanger means;

(e) means to pass liquid from the heat exchanger means to the upper portion of the stripping column; and (f) means to recover fluid from the stripping column.

The term, "column", as used herein means a distillation of fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3 *The Continuous Distillation Process*. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

The term "indirect heat exchange", as used herein means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contactinq stage whereby the vapor and liquid leaving the stage are in mass transfer equilibrium, e.g. a tray having 100 percent efficiency or a packing element height equivalent to one theoretical plate (HETP).

As used herein, the term "stripping column" means a column operated with sufficient vapor upflow relative to liquid downflow to achieve separation of a volatile component such as argon from the liquid into the vapor in which the volatile component such as argon becomes progressively richer upwardly.

As used herein, the term "absorbing column" means a column operated with sufficient liquid downflow relative to vapor upflow to achieve separation of a less volatile component such as methane from the vapor into the liquid in which the less volatile component such as methane becomes progressively richer downwardly.

As used herein, the term "reboiler" means a heat exchange device which generates column upflow vapor from column bottom liquid.

As used herein, the term "condenser" means a heat exchange device which generates column downflow liquid from column top vapor.

BRIEF DESCRIPTION OF THE DRAWINGS

FIG. 3 is a schematic flow diagram of one way to carry out certain heat exchange operations of the embodiment of FIG. 2.

FIG. 4 is a schematic flow diagram of another way to carry out certain heat exchange operations of the embodiment of FIG. 2.

DETAILED DESCRIPTION

The invention will be discussed in detail with reference to the drawings.

Figure 1:
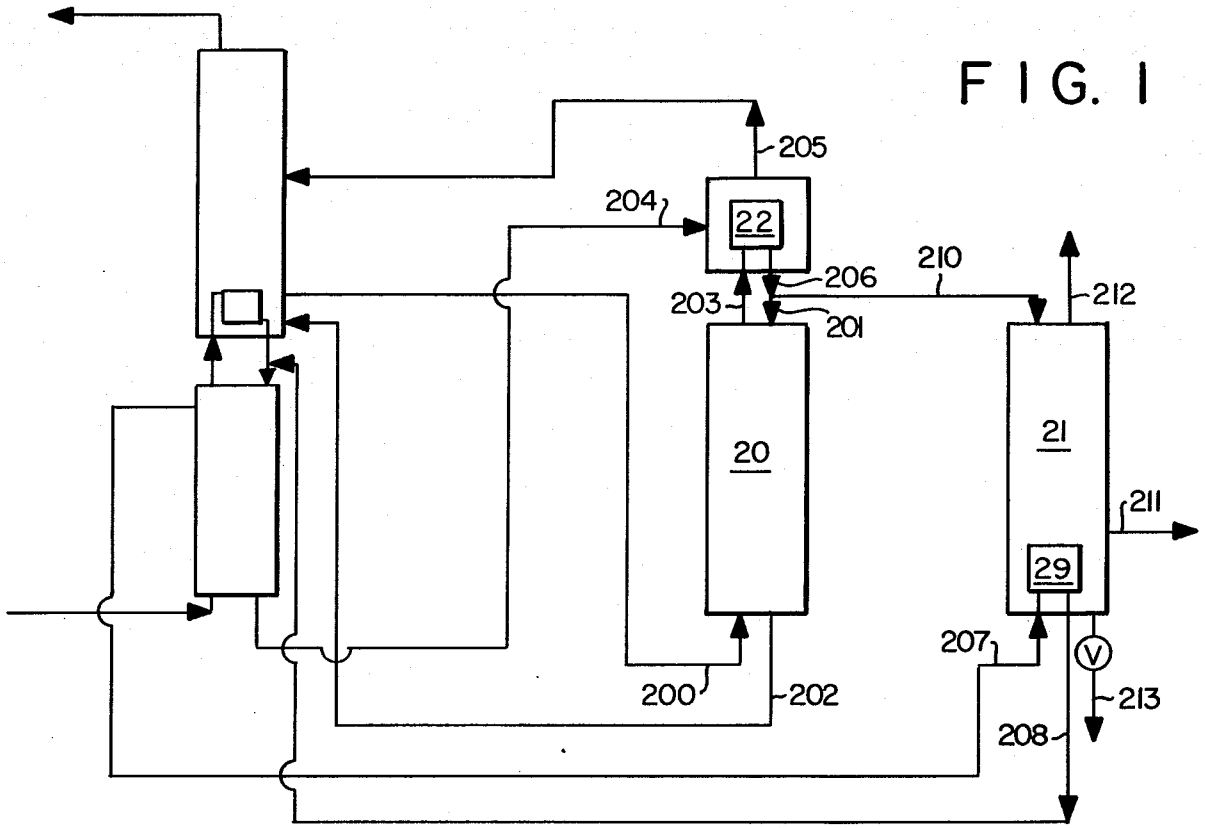
FIG. 1 is a schematic flow diagram of one preferred embodiment of the invention wherein the invention is employed as an addition to a cryogenic distillation air separation plant.

Referring now to FIG. 1, gaseous feed 200 is introduced into the lower portion of absorbing column 20. Feed gas 200 is comprised primarily of oxygen, generally at a concentration within the range of from 90.0 to 99.9 percent. Typically feed gas 200 is commercial grade high purity oxygen having a concentration of about 99.5 percent oxygen. Feed gas 200 also contains light impurities, such as argon, nitrogen, hydrogen and helium, which have a higher vapor pressure or volatility than oxygen, and heavy impurities such as krypton, xenon and hydrocarbons, which have a lower vapor pressure or volatility than oxygen.

In the embodiment of FIG. 1, feed gas 200 is taken directly from a cryogenic air separation plant. In the case where the cryogenic air separation plant is of the double column type, preferably the feed gas is taken from the bottom of the upper column.

The feed gas is passed up absorbing column 20 and heavy impurities are absorbed from the ascending gas into descending or wash liquid. As used herein "impurities" means both one specie of impurity as well as more than one specie. When a double column cryogenic air separation plant is employed with the embodiment illustrated in FIG. 1, it is preferred that resulting wash liquid 202 be passed to the oxygen side of the double column main condenser.

Resulting washed gas 203 is passed from the upper portion of column 20, such as by conduit means, to heat exchanger 22 wherein it is condensed by indirect heat exchange. Heat exchanger 22 could be outside absorbing column 20, as shown in FIG. 1, or could be within a structure which also houses the absorbing column. Heat exchanger 22 is driven by any suitable fluid 204. Preferably fluid 204 is liquid taken from the bottom of the higher pressure column of a double column air separation plant and the resulting vaporized fluid 205 is returned to the double column in the midsection of the lower pressure column.

A first portion 210 of resulting liquid 206 from heat exchanger 22 is passed through conduit means into the upper portion of stripping column 21 while a second portion 201 is passed down absorbing column 20 as the descending liquid.

Liquid 210 is passed down stripping column 21 and light impurities are stripped from the downflowing liquid into upflowing vapor which exits stripping column 21 as gaseous stream 212. Stream 212 is commercial grade high purity oxygen which is essentially free of hydrocarbons and other heavy impurities. As such, stream 212 may be recovered as a secondary product.

Ultra high purity oxygen liquid produced within stripping column 21 is vaporized by indirect heat exchange by reboiler 29 and the resulting vapor is passed up stripping column 21 as the upflowing vapor. Reboiler 29 is driven by any suitable fluid 207. Preferably fluid 207 is vapor taken from the upper portion of the higher pressure column of a double column air separation plant and the resulting condensed fluid 208 is returned to the double column as reflux liquid.

Product ultra high purity oxygen may be recovered from stripping column 21 as gaseous stream 211 after vaporization by reboiler 29 and/or may be recovered as liquid 213 before vaporization. When producing gaseous oxygen, reboiler 29 vaporizes substantially all of the liquid which downflows to the bottom of column 21. Some liquid may be removed through stream 213 as drainage if a significant amount of product is recovered as gas in order to ensure safe operation of reboiler 29.

Figure 2:
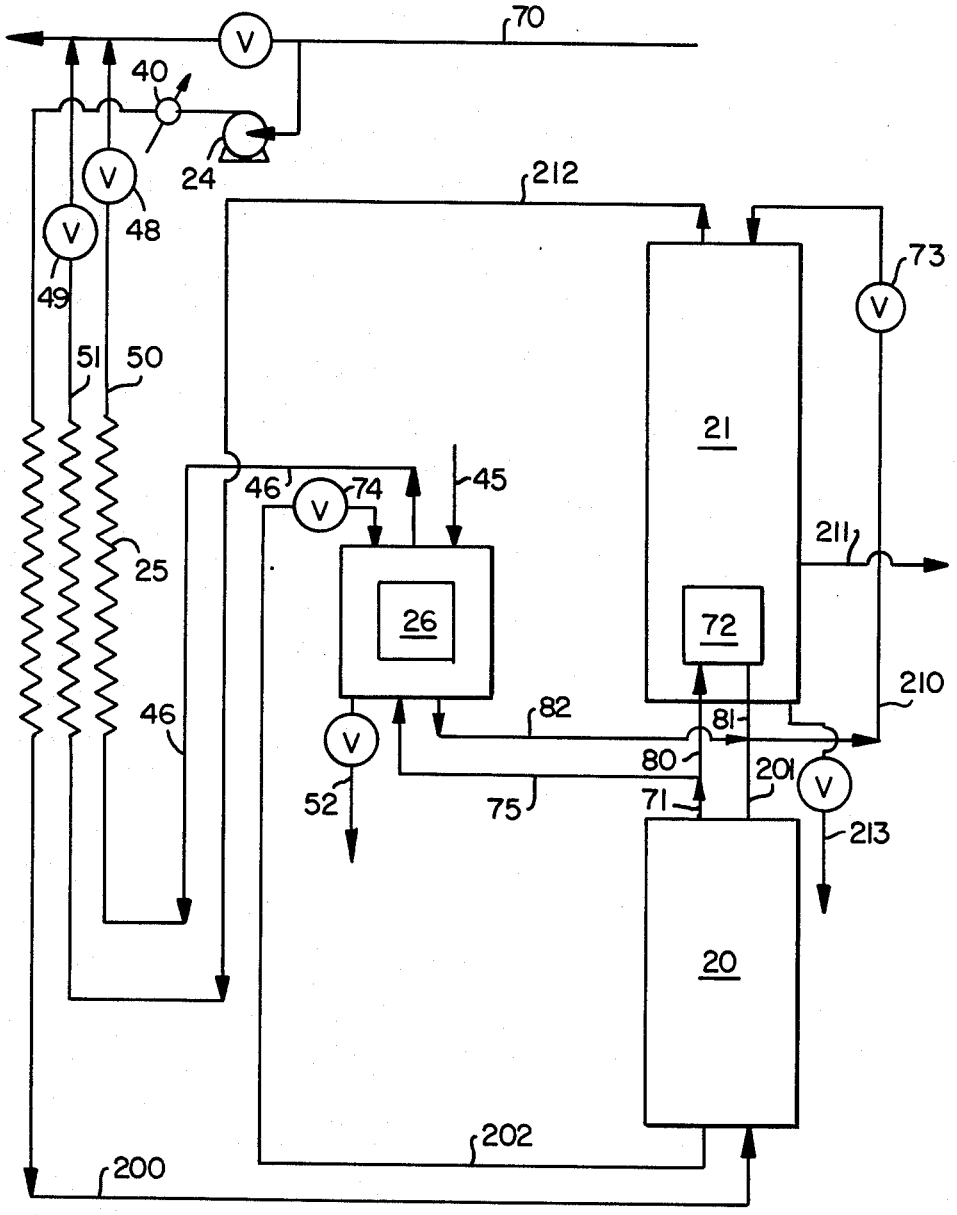
FIG. 2 is a schematic flow diagram of a particularly preferred embodiment of the invention wherein the invention is employed standing alone utilizing liquid oxygen addition refrigeration or liquid nitrogen addition refrigeration.

FIG. 2 illustrates a particularly preferred embodiment of the invention which may be employed independent from a cryogenic air separation plant. The numerals in FIG. 2 correspond to those of FIG. 1 for the common elements.

Referring now to FIG. 2, gaseous oxygen 70 is compressed by compressor 24, cooled by cooler 40 and further cooled by indirect heat exchange in heat exchanger 25 against return streams. Resulting gaseous feed 200 is introduced into absorbing column 20 wherein it ascends and is washed of heavy impurities by descending liquid.

Absorbing column 20 is less sensitive to pressure than is stripping column 21. This lower sensitivity can be put to advantage by operating absorbing column 20 at a higher pressure than that at which stripping column 21 is operated. This enables the use of dual heat exchangers for the condensation of the washed gas, and furthermore enables one of these heat exchangers to be the reboiler of stripping column 21.

Referring back now to FIG. 2, portion 80 of washed gas 71 is passed through conduit means to heat exchanger 72 wherein it is condensed. Heat exchanger 72 is the bottom reboiler of stripping column 21 and is driven by the condensing washed gas so as to vaporize ultra high purity oxygen stripping column bottoms. First portion 210 of resulting liquid 81 from heat exchanger 72 is passed through valve 73 and into the upper portion of stripping column 21 while second portion 201 is passed down absorbing column 20 as the descending liquid. Wash liquid 202 is passed out of absorbing column 20, expanded through valve 74, vaporized in side condenser 26 and the resulting vaporized stream 46 is warmed by passage through heat exchanger 25 and passed out of the process through valve 48 as stream 50.

Portion 75 of washed gas 71 is passed to side condenser 26 wherein it is condensed and is removed as condensed stream 82. Stream 82 is combined with stream 81 and the resulting stream is divided into streams 210 and 201.

To compensate for system heat leakage, liquid oxygen 45 is passed through side condenser 26 and out of side condenser 26 as part of stream 46. Stream 52 is a drain utilized for contaminant control in side condenser 26.

As previously mentioned, liquid 210 is expanded through valve 73 and passed into and down stripping column 21. Light impurities are stripped from the downflowing liquid into upflowing vapor which exits stripping column 21 as gaseous stream 212. Stream 212 is warmed by passage through heat exchanger 25 and passed out of the process through valve 49 as stream 51.

Depending upon the value of hydrocarbon-free stream 51, streams 46 and 212 can be mixed ahead of heat exchanger 25 to reduce heat exchanger 25 to a two pass heat exchanger. Also in this embodiment, additional liquid nitrogen or other refrigeration can be utilized either directly to condense oxygen vapor from the top of the absorbing column, such as by inserting a liquid nitrogen cooling heat exchange means into side condenser 26 as illustrated in FIG. 3, or indirectly through an auxiliary oxygen condenser 27 to condense a small portion 212A of hydrocarbon free oxygen vapor stream 212 for insertion as stream 45 into side condenser 26 as illustrated in FIG. 4.

The numerals in FIG. 3 correspond to those of FIG. 2 for the common elements. Referring now to FIG. 3, liquid nitrogen addition stream 55 is vaporized to condense a portion of stream 75 from the top of absorbing column 20. Vaporized nitrogen stream 56 is warmed and exits via an extra nitrogen pass provided in heat exchanger 25.

Referring now to FIG. 4, an auxiliary oxygen condenser 27 is provided to generate liquid oxygen addition stream 45 from a portion 212A of stream 212. Liquid nitrogen stream 55 is vaporized by the indirect heat exchange with stream 212A and vaporized nitrogen stream 56 is warmed and exits via an extra nitrogen pass provided in heat exchanger 25.

The embodiments illustrated in FIG. 3 and 4 which utilize liquid nitrogen addition for purposes of heat balance and to condense oxygen are preferred ways of achieving this heat balance and condensation. However, those skilled in the art will recognize that there are many other ways to carry this out within the scope of the process of this invention. For example, it would be possible to combine heat exchangers 26 and 72 into one multipass single unit. One pass would condense stream 71, another would vaporize stream 202, another would vaporize the liquid from the bottom of column 21, and another would vaporize the liquid nitrogen addition. Such a single multipass heat exchanger would require liquid recirculation or liquid drains from the oxygen rich passes to ensure safe operation of the heat exchanger unit.

Ultra high purity oxygen liquid produced within stripping column 21 is vaporized by indirect heat exchange by reboiler 72 and the resulting vapor is passed up stripping column 21 as the upflowing vapor. As previously mentioned, reboiler 72 is driven by washed vapor from the absorbing column. Product ultra high purity oxygen may be recovered from stripping column 21 as gas 211 after vaporization by reboiler 72 and/or may be recovered as liquid 213 before the vaporization. Reboiler 72 vaporizes substantially all of the liquid which downflows to the bottom of column 21 other than the product liquid 213. Some small amount of liquid may be removed through stream 213 if a significant amount of product is recovered in gaseous form via 211 in order to ensure safe operation of reboiler 72.

The absorbing column useful with the invention operates at a pressure within the range of from 10.3 to 103 pounds per square inch absolute (psia) (0.7 to 7.0 atmospheres). The stripping column useful with the invention operates at a pressure within the range of from 10.3 to 73.5 psia (0.7 to 5.0 atmospheres) and preferably within the range of from 1 to 4 atmospheres.

Typically the product ultra high purity oxygen of this invention will have an oxygen purity of at least 99.999 percent and may have a purity of up to 99.99999 percent.

The absorbing column is operated such that methane absorbing factor A preferably exceeds 1.0 and most preferably exceeds 1.1. Methane absorbing factor $A=l/kv$ where l is the liquid molar flow in the absorbing column, v is the vapor molar flow in the absorbing column, and k is the ratio of the mole fraction of methane impurity in the gas phase and the mole fraction of methane impurity in the liquid phase at thermodynamic equilibrium. When operated in this manner, the absorbing column serves to reduce the concentration of methane from that of stream 200 to that of stream 210 by about three orders of magnitude. Since methane is the most volatile of the heavy impurities, all other heavy impurities will be reduced in concentration by operation of the absorbing column by an even greater factor.

The stripping column is operated such that argon stripping factor S preferably exceeds 1.0 and most preferably exceeds 1.1. Argon stripping factor $S=KV/L$ where V is the vapor molar flow in the stripping column, L is the liquid molar flow in the stripping column, and K is the ratio of the mole fraction of argon impurity in the gas phase and the mole fraction of argon impurity in the liquid phase at thermodynamic equilibrium. When operated in this manner, the stripping column serves to reduce the concentration of argon from that of stream 210 to that of the product ultra high purity oxygen by about three orders of magnitude. Since argon is the least volatile of the light impurities, all other light impurities will be reduced in concentration by operation of stripping column by an even greater factor.

Either of the absorbing column or the stripping column, or both, may be comprised of a series of vertically spaced trays or of column packing. Those skilled in the mass transfer art are familiar with the many types of trays and column packing available and no further detailed discussion is necessary here.

The results of a computer simulation of the invention carried out with the embodiment illustrated in FIG. 1 are presented in Table 1. The stream numbers in Table 1 correspond to those of FIG. 1. The abbreviation CFH stands for cubic foot per hour at standard conditions of 1 atmosphere and 70 degrees Fahrenheit, ° K. stands for degrees Kelvin, and PPM stands for parts per million. The stripping column operated at an argon stripping factor of 1.2 and had 34 equilibrium stages or theoretical trays and the absorbing column operated at a methane absorbing factor of 1.2 and had 31 equilibrium stages or theoretical trays. The invention was operated as an addition to a double column air separation plant. As can be seen, the argon impurity is reduced from 4000 to 5 ppm and the methane impurity is reduced from 10 to 0.04 ppm. Furthermore, as can be seen, stream 212 which is substantially free of hydrocarbons and other heavy impurities may be recovered at a flow rate of about one half that of the incoming feed. Since the product ultra high purity oxygen is recovered as liquid, gas stream 211 is not used.

TABLE 1

| Stream No. | Flow, CFH | Pressure, PSIA | Temperature °K. | Impurity, PPM Argon | Methane |
|---|---|---|---|---|---|
| 200-gas | 7740 | 25.5 | 95.9 | 4000 | 10 |
| 201-liquid | 2830 | 23.1 | 94.8 | 4776 | 0.01 |
| 202-liquid | 2830 | 25.5 | 95.9 | 2653 | 27.3 |
| 210-liquid | 4910 | 23.1 | 94.8 | 4776 | 0.01 |
| 211-gas | 0 | 25.5 | 95.9 | — | — |
| 212-gas | 3910 | 23.1 | 94.8 | 5997 | 0.003 |
| 213-liquid | 1000 | 25.5 | 95.9 | 5 | 0.04 |

A major advantage of the embodiment of the invention such as is illustrated in FIG. 1 is that there is no need for additional oxygen compression or additional heat pump compression as would also be possible if feed gaseous oxygen is available at pressure for the FIG. 2 embodiment. In such a case, compressor system components 24 and 40 shown in FIG. 2 would be omitted.

The results of a computer simulation of the invention carried out with the embodiment illustrated in FIG. 2 are presented in Table 2. The stream numbers in Table 2 correspond to those of FIG. 2. The stripping column operated at an argon stripping factor of 1.2 and had 35 equilibrium stages or theoretical trays and the absorbing column operated at a methane absorbing factor of 1.2 and had 31 equilibrium stages or theoretical trays. As can be seen, the argon impurity is reduced from 4000 to 5 ppm and the methane impurity is reduced from 10 to 0.04 ppm.

TABLE 2

| Stream No. | Flow, CFH | Pressure, PSIA | Temperature °K. | Impurity, PPM Argon | Methane |
|---|---|---|---|---|---|
| 70-gas | 7900 | 37 | 300 | 4000 | 10 |
| 200-gas | 7900 | 33.5 | 99 | 4000 | 10 |
| 202-liquid | 2990 | 33 | 98.8 | 2703 | 26.4 |
| 210-liquid | 4910 | 30.5 | 97.9 | 4790 | 0.01 |
| 213-liquid | 1000 | 25.5 | 95.9 | 5 | 0.04 |
| 45-liquid | 1190 | 23.1 | 94.8 | 4000 | 10 |
| 46-gas | 4180 | 23.1 | 94.8 | 3073 | 21.7 |
| 50-gas | 4180 | 20 | 292 | 3073 | 21.7 |
| 212-gas | 3910 | 23.1 | 94.8 | 6014 | 0.003 |
| 51-gas | 3910 | 20 | 292 | 6014 | 0.003 |

Although the process and apparatus of this invention have been described in detail with reference to certain preferred embodiments, those skilled in the art will recognize that there are other embodiments of this invention within the spirit and scope of the claims.

I claim:

1. A process to produce ultra high purity oxygen from a gaseous feed comprising:

(a) introducing gaseous feed containing oxygen, light impurities and heavy impurities into an absorbing column;

(b) passing gaseous feed up the absorbing column and absorbing heavy impurities from ascending gas into descending liquid;

(c) condensing resulting gas, passing a first liquid portion thereof into a stripping column and passing a second portion thereof down the absorbing column as said descending liquid;

(d) passing first liquid portion down the stripping column and stripping light impurities from the downflowing liquid into upflowing vapor to produce ultra high purity oxygen liquid;

(e) vaporizing ultra high purity oxygen liquid and passing resulting vapor up the stripping column as said upflowing vapor; and (f) recovering product ultra high purity oxygen.

2. The process of claim 1 wherein the product ultra high purity oxygen has an oxygen concentration of at least 99.999 percent.

3. The process of claim 1 wherein product ultra high purity oxygen is recovered as liquid.

4. The process of claim 1 wherein product ultra high purity oxygen is recovered as vapor after the vaporization of step (e).

5. The process of claim 1 wherein the feed gas is taken from a double column cryogenic air separation plant from the bottom of the upper column and liquid containing washed heavy impurities is passed from the lower portion of the absorbing column into the cryogenic air separation plant at the oxygen side of the main condenser.

6. The process of claim 1 wherein the stripping column is operated so that the argon stripping factor S is greater than 1 where $S=KV/L$, V is the vapor molar flow in the stripping column, L is the liquid molar flow in the stripping column, and K is the ratio of the mole fraction of argon impurity in the gas phase and the mole fraction of argon impurity in the liquid phase at thermodynamic equilibrium.

7. The process of claim 1 wherein the absorbing column is operated so that the methane absorbing factor A is greater than 1 where $A=1/kv$, is the liquid molar flow in the absorbing column, v is the vapor molar flow in the absorbing column, and k is the ratio of the mole fraction of methane impurity in the gas phase and the mole fraction of methane impurity in the liquid phase at thermodynamic equilibrium.

8. The process of claim 1 wherein the stripping column is operated at a pressure within the range of from 10.3 psia to 73.5 psia.

9. The process of claim 1 wherein the absorbing column is operated at a pressure within the range of from 10.3 psia to 103 psia.

10. The process of claim 1 wherein the condensation of step (c) is carried out, in part, by indirect heat exchange with liquid containing washed heavy impurities.

11. The process of claim 1 wherein the condensation of step (c) is carried out, in part, by indirect heat exchange with the vaporizing ultra high purity oxygen liquid of step (e).

12. The process of claim 1 wherein the condensation of step (c) is carried out, in part, by indirect heat exchange with additional liquid nitrogen.

13. The process of claim 1 further comprising condensing a portion of the top vapor from the stripping column by indirect heat exchange with additional liquid nitrogen and thereafter carrying out the condensation of step (c), in part, by indirect heat exchange with said condensed portion.

14. The process of claim 1 wherein at least some of the upflowing vapor taken from the upper portion stripping column is recovered as substantially hydrocarbon-free oxygen gas.

15. The process of claim 1 wherein the absorbing column is operated at a pressure which exceeds that at which the stripping column is operated.

16. The process of claim 15 wherein the condensation of step (c) is carried out in two heat exchange operations, the first heat exchange operation being against the vaporizing ultra high purity oxygen liquid of step (e) and the second heat exchange operation being against, at least in part, liquid containing washed heavy impurities.

17. Apparatus to produce ultra high purity oxygen from a gaseous feed comprising:

(a) an absorbing column having feed introduction means;

(b) a stripping column;

(c) first heat exchanger means, said first heat exchanger means being within the stripping column;

(d) means to pass vapor from the upper portion of the absorbing column to said first heat exchanger means;

(e) means to pass liquid from said first heat exchanger means to the upper portion of the stripping column;

(f) second heat exchanger means, conduit means from the upper portion of the absorbing column to the second heat exchanger means, and conduit means from the second heat exchanger means to the upper portion of the stripping column; and (g) means to recover fluid from the stripping column.

18. The apparatus of claim 17 further comprising conduit means from the lower portion of the absorbing column to the second heat exchanger means.

19. The apparatus of claim 17 further comprising means to provide liquid nitrogen to said second heat exchanger means.

20. The apparatus of claim 17 further comprising condensing means, means to pass some vapor from the upper portion of the stripping column to the condensing means, and means to pass condensed fluid from the condensing means to said second heat exchanger means.

21. Apparatus to produce ultra high purity oxygen from a gaseous feed comprising:

(a) a cryogenic air separation plant;

(b) an absorbing column;

(c) means to pass feed gas from the cryogenic air separation plant to the absorbing column and means to pass liquid from the absorbing column to the cryogenic air separation plant;

(d) a stripping column;

(e) heat exchanger means;

(f) means to pass vapor from the upper portion of the absorbing column to the heat exchanger means;

(g) means to pass liquid from the heat exchanger means to the upper portion of the stripping column and to the upper portion of the absorbing column; and (h) means to recover fluid from the stripping column.

22. The apparatus of claim 21 wherein the cryogenic air separation plant is a double column plant comprising a higher pressure column and lower pressure column in heat exchange relation at a main condenser.

23. The apparatus of claim 22 wherein the feed gas pass means of part (c) runs from the lower pressure column to the absorbing column and the liquid pass means of part (c) runs from the absorbing column to the main condenser.

24. The apparatus of claim 22 further comprising means to pass fluid from the higher pressure column to the heat exchanger means, and means to pass fluid from the heat exchanger means to the lower pressure column.

25. The apparatus of claim 22 further comprising a reboiler to vaporize stripping column liquid, means to pass fluid from the higher pressure column to the reboiler and means to pass fluid from the reboiler to the cryogenic air separation plant.

* * * * *

UNITED STATES PATENT AND TRADEMARK OFFICE

CERTIFICATE OF CORRECTION

PATENT NO. : 4,755,202

DATED : July 5, 1988

INVENTOR(S) : Harry Cheung

It is certified that error appears in the above-identified patent and that said Letters Patent is hereby corrected as shown below:

In claim 7, line 3 between "1/kv," and "is", second occurrence, insert --1--.

Signed and Sealed this

Eighth Day of November, 1988

*Attest:*

DONALD J. QUIGG

*Attesting Officer*

*Commissioner of Patents and Trademarks*